United States Patent [19]

Allan

[11] 4,225,187

[45] Sep. 30, 1980

[54] SCABBLER BIT FLOOR SURFACING MACHINE

[75] Inventor: David T. Allan, 9 Broomhill Dr., Rutherglen, 6 Glasgow, Scotland, G3 3QH

[73] Assignees: David Thomson Allan; John MacDonald & Co. (Pneumatic Tools) Ltd., both of Glasgow, Scotland

[21] Appl. No.: 931,071

[22] Filed: Aug. 4, 1978

[30] Foreign Application Priority Data

Aug. 4, 1977 [GB] United Kingdom ..... 32691/77

[51] Int. Cl.[3] ..... E21C 35/18

[52] U.S. Cl. ..... 299/37; 299/94; 125/6

[58] Field of Search ..... 299/37, 69, 70, 62, 299/94; 29/81 D, 81 L; 125/6, 26, 29, 38, 40; 175/91, 96, 319, 381, 416; 51/170 TL; 407/13; 173/24

[56] References Cited

U.S. PATENT DOCUMENTS

| | | | |
|---|---|---|---|
| 1,554,446 | 9/1925 | Loy | 175/319 X |
| 1,727,915 | 9/1929 | Thomson | 29/81 D |
| 2,400,853 | 5/1946 | Stilley | 175/381 X |
| 2,546,768 | 3/1951 | Mills | 29/81 D |
| 3,366,420 | 1/1968 | Young | 299/37 |
| 3,680,643 | 8/1972 | Cameron et al. | 173/24 X |
| 4,071,100 | 1/1978 | Wibom | 175/416 X |

FOREIGN PATENT DOCUMENTS

| | | | |
|---|---|---|---|
| 2025639 | 12/1970 | Fed. Rep. of Germany | 299/69 |
| 973100 | 2/1951 | France | 29/81 D |

*Primary Examiner*—Ernest R. Purser

*Attorney, Agent, or Firm*—Bertram Frank

[57] ABSTRACT

A scabbler machine for breaking concrete etc. having a number of scabbling bits made up of a shank for connection to the reciprocal piston of the scabbler machine and a head provided with tungsten carbide, or like, cutting members. To ensure complete scabbling of the surface to be treated the head of the scabbling bits have portions which overlie portions of other bits so that the bits overlap one another in the direction of movement of the scabbler machine over the surface to be treated.

5 Claims, 7 Drawing Figures

SCABBLER BIT FLOOR SURFACING MACHINE

This invention relates to cutting tools or bits for use on scabbler machines and other concrete dressing machinery and for use on scaling hammer or the like (for convenience, such machines will be hereinafter referred to as "scabbler machines").

Concrete scabbler machines are known and have been manufactured for some time by the Applicant. One example of such a machine is described in the Applicant's British Pat. No. 1,056,011. Hand-held scabbler machines are also manufactured by the Applicant. Moreover, so-called scaling hammers are well known and are manufactured by numerous companies.

One of the disadvantages of such known machines is that when they are multi-headed, i.e. they have more than one bit operating at any one time it is difficult to obtain complete coverage of the surface being scabbled or dressed as the machine moves forward. This problem has, in the past, been overcome by providing more than one row of bits with the bits in the second row filling the gaps between the bits in the first row. Providing more than one row increases manufacturing costs and increases unnecessarily the dimensions of the machine and its power consumption.

An object of the present invention is to obviate or mitigate the aforementioned disadvantages.

According to the present invention there is provided a pair of bits for a scabbler machine, each bit comprising a shank adapted to be connected to the reciprocable piston of a scabbler machine and a head provided with tungsten carbide, or like, cutting members and in which each head is adapted to interengage with the head of the other bit of the pair.

Preferably, said pair of bits are interlocking.

Preferably also, said bits are substantially rectangular and are provided with substantially rectangular interlocking formations on at least one edge.

Preferably also, said bits are substantially T-shaped.

Preferably also, said bits are diamond shaped.

Embodiments of the present invention will now be described by way of example, with reference to the accompanying drawings, in which.

Figure 1:
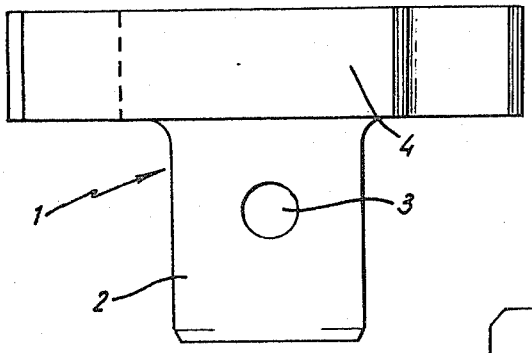
FIG. 1 is a side view of a bit according to the present invention.
Figure 2:
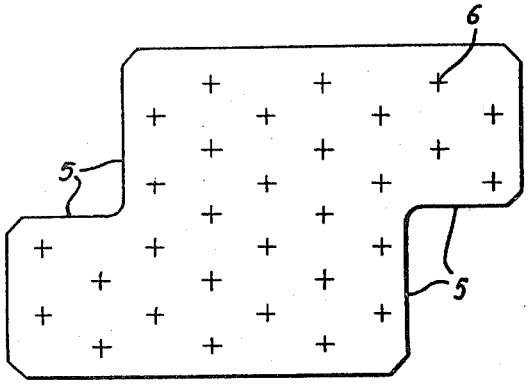
FIG. 2 is a plan view corresponding to FIG. 1.

Referring to the drawings FIGS. 1 and 2 show a bit for a scabbler machine, indicated generally at 1. The bit comprises a shank 2 provided with an internal bore (not shown) adapted to accommodate one end of the reciprocable piston of a scabbler machine. The bore is provided with a bottom face (not shown) which engages the end of the piston and a hole 3 is provided in the shank, which hole is adapted to co-operate with a hole in the piston of similar size but with the centres offset when the end of the piston is in engagement with the bottom of the bore. A spring pin (not shown) is forced through the holes in the shank and the piston to prestress the piston into engagement with the bottom of the bore. The above describes one method of connecting the bit to a piston but clearly any other suitable method may be used.

Figure 3:
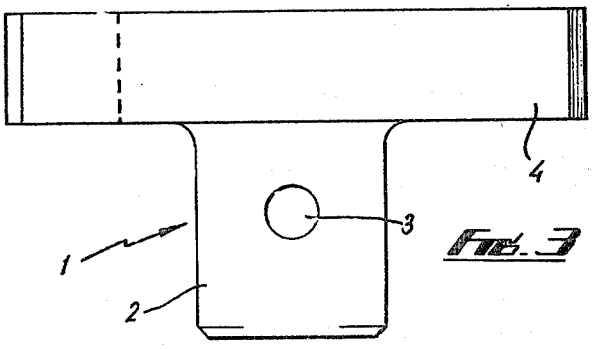
FIG. 3 is a side view of a modified bit according to the present invention.
Figure 4:
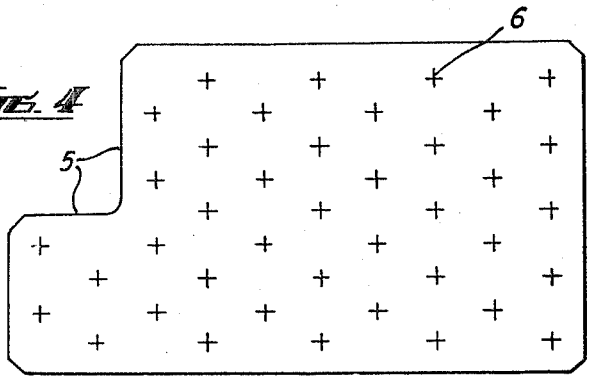
FIG. 4 is a plan view corresponding to FIG. 2.

The sank 2 is connected to a head 4 of the bit, which head is provided with tungsten carbide cutting tips, the positions of which are shown at 6 in FIG. 2. In a scabbler machine such as that described in the Applicant's U.S. Pat. No. 1,056,011 the bits are provided in two off-set rows in order to obtain full coverage across the workpiece being scabbled. With the bits according to the present invention only one row need be provided as the head 4 of each bit is provided with formations 5 which will engage with similar formations on the adjacent bit or bits. Clearly, in order to achieve this the bits are provided in interengageable pairs although the end bit of any row while being one of a pair, i.e. one for each end of the row, need only have formations 5 on one side as shown in the modification of FIGS. 3 and 4.

Figure 5:
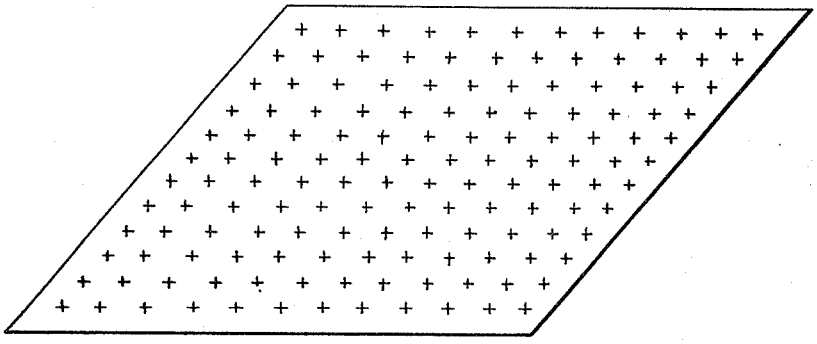
FIGS. 5 to 7 are plan views of further modified bits.
Figure 6:
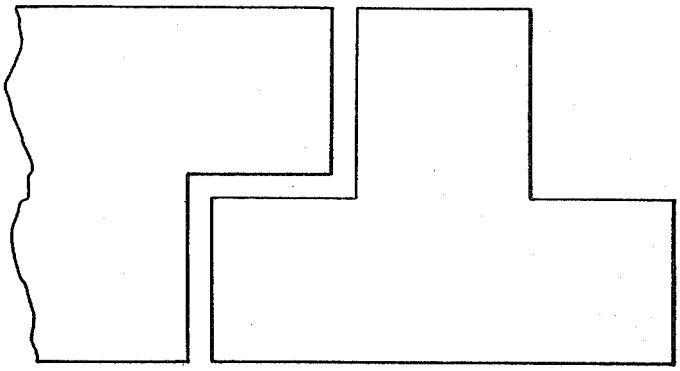
Figure 7:
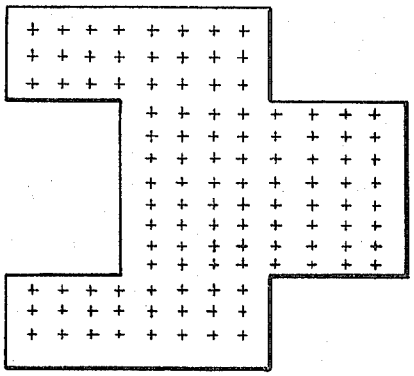

Different formations may be used in other modifications such as those shown in FIGS. 5, 6 and 7 so as to obtain overall coverage. In order to prevent the bits turning during operation at least one of the bits may be restrained in its normal working position by any suitable means, or alternatively the pistons of the scabbler machine may be constrained from rotating during operation. Moreover, it is desirable that the thickness of the heads adjacent bits in such that overriding of adjacent heads due to random rotation is avoided.

What we claim is:

1. A scabbler machine having at least one pair of scabbling bits, said bits being aligned in a direction perpendicular to the path of movement of the scabbler machine, each bit having a shank for connection to the reciprocal piston of the scabbler machine and a head provided with tungsten carbide or like, cutting members, the head of one bit of said pair having a portion which overlies a portion of the other bit of said pair so that the bits of said pair overlap one another in the direction of movement of the scabbler machine over the surface to be treated.

2. A scabbler machine as claimed in claim 1 in which said pair of bits are interlocking.

3. A scabbler machine as claimed in claim 1 in which said bits are substantially rectangular and are provided with substantially rectangular interlocking formations on at least one edge.

4. A scabbler machine as claimed in claim 1 in which said bits are substantially T-shaped.

5. A scabbler machine as claimed in claim 1 in which said bits are diamond shaped.

* * * * *